US007900602B2

(12) United States Patent
Petrone et al.

(10) Patent No.: US 7,900,602 B2
(45) Date of Patent: Mar. 8, 2011

(54) DIRECT INJECTION ASSEMBLY OF THE COMMON-RAIL TYPE PROVIDED WITH A SHUT-OFF VALVE FOR CONTROLLING THE DELIVERY OF A HIGH-PRESSURE FUEL PUMP

(75) Inventors: Michele Petrone, San Lazzaro Di Savena (IT); Pasquale Dragone, Bologna (IT); Massimo Mattioli, Calderara di Reno (IT); Daniele De Vita, Castel San Pietro Terme (IT); Andrea Cobianchi, Bologna (IT)

(73) Assignee: Magneti Marelli S.p.A., Corbetta (IT)

( * ) Notice: Subject to any disclaimer, the term of this patent is extended or adjusted under 35 U.S.C. 154(b) by 34 days.

(21) Appl. No.: 12/398,114

(22) Filed: Mar. 4, 2009

(65) Prior Publication Data

US 2009/0229573 A1 Sep. 17, 2009

(30) Foreign Application Priority Data

Mar. 4, 2008 (EP) ..... 08425135

(51) Int. Cl.
*F02M 57/02* (2006.01)

(52) U.S. Cl. ..... 123/446; 123/511

(58) Field of Classification Search ..... 123/446, 123/447, 510, 511, 514
See application file for complete search history.

(56) References Cited

U.S. PATENT DOCUMENTS 4,884,545 A * 12/1989 Mathis ..... 123/447
5,878,718 A * 3/1999 Rembold et al. ..... 123/456
6,142,120 A * 11/2000 Biester et al. ..... 123/456
6,234,148 B1 * 5/2001 Hartke et al. ..... 123/447
6,253,734 B1 * 7/2001 Rembold et al. ..... 123/446
6,293,253 B1 * 9/2001 Arnold et al. ..... 123/458
6,311,669 B1 * 11/2001 Przymusinski et al. ..... 123/300
6,609,500 B2 * 8/2003 Ricco et al. ..... 123/446
6,792,915 B2 * 9/2004 Rembold et al. ..... 123/446
7,128,054 B2 * 10/2006 Koehler et al. ..... 123/446
7,293,548 B2 * 11/2007 Oono ..... 123/446
7,343,901 B2 * 3/2008 Mori et al. ..... 123/446

(Continued)

FOREIGN PATENT DOCUMENTS

DE 19904341 8/2000

(Continued)

OTHER PUBLICATIONS

European Search Report for European Application No. 08425135, European Patent Office, Jul. 11, 2008.

*Primary Examiner* — Thomas N Moulis
(74) *Attorney, Agent, or Firm* — Dylan O. Adams; Graybeal Jackson LLP

(57) ABSTRACT

An embodiment of a direct injection assembly of the common-rail type provided with a fuel tank, a manifold, a high-pressure pump for feeding the fuel to the manifold, a low-pressure pump provided with an intake pipe and connected to the high-pressure pump by means of the intake pipe to feed the fuel taken from the tank to the high-pressure pump; and a shut-off valve of the ON/OFF type which is arranged along the intake pipe to adjust the delivery of the fuel fed to the high-pressure pump; and a pressure regulator, which is arranged along the intake pipe immediately upstream of the shut-off valve to keep the pressure of the fuel inside the intake pipe under a predetermined value.

38 Claims, 3 Drawing Sheets

U.S. PATENT DOCUMENTS

| | | | | |
|---|---|---|---|---|
| 7,377,753 | B2 * | 5/2008 | Kuroda | 417/251 |
| 7,431,018 | B2 * | 10/2008 | Tsujimoto | 123/446 |
| 7,503,313 | B2 * | 3/2009 | Achleitner et al. | 123/446 |
| 7,634,985 | B2 * | 12/2009 | Parker et al. | 123/435 |
| 2002/0000217 | A1 | 1/2002 | Takahashi et al. | |
| 2004/0208753 | A1 * | 10/2004 | Mori | 417/244 |

FOREIGN PATENT DOCUMENTS

| | | |
|---|---|---|
| DE | 102006037174 | 2/2008 |
| EP | 0481964 | 4/1992 |
| EP | 1147313 | 10/2001 |
| EP | 1612402 | 1/2006 |
| EP | 1707795 | 10/2006 |
| EP | 1709317 | 10/2006 |
| EP | 1712775 | 10/2006 |
| WO | 0140656 | 6/2001 |
| WO | 2005075809 | 8/2005 |

* cited by examiner

DIRECT INJECTION ASSEMBLY OF THE COMMON-RAIL TYPE PROVIDED WITH A SHUT-OFF VALVE FOR CONTROLLING THE DELIVERY OF A HIGH-PRESSURE FUEL PUMP

PRIORITY CLAIM

The present application claims the benefit of European Patent Application Serial No. 08425135.4, filed Mar. 4, 2008, which application is incorporated herein by reference in its entirety.

TECHNICAL FIELD

An embodiment of the present invention relates to a direct injection assembly of the common-rail type provided with a shut-off valve for controlling the delivery of a high-pressure fuel pump.

BACKGROUND ART

In a direct injection assembly of the common-rail type, it is known to use a high-pressure pump which receives a fuel flow from a tank by means of a low-pressure pump and feeds the fuel to a common-rail hydraulically connected to a plurality of injectors. As known, in such a direct injection assembly of the common-rail type, the pressure of the fuel inside the common-rail must be constantly controlled according to the driving point either by varying the instantaneous delivery of the high-pressure pump or by constantly feeding an excess of fuel to the common-rail and by discharging the fuel in excess from the common-rail itself by means of an adjustment valve. Generally, the solution of varying the instantaneous delivery of the high-pressure pump is preferred, because this solution displays a much better energy efficiency and does not result in overheating the fuel inside the tank.

In order to vary the instantaneous fuel flow of the high-pressure pump, it has been proposed, for example in EP-A-0481964, which is incorporated by reference, to use a varying delivery high-pressure pump able to feed to the common-rail only the amount of fuel needed to keep the pressure of the fuel inside the common-rail equal to a desired value.

Specifically, the high-pressure pump proposed in EP-A-0481964 is provided with an electromagnetic actuator able to vary instant-by-instant the delivery of the high-pressure pump itself by varying the closing instant of an intake valve of the high-pressure pump.

Alternatively, in order to vary the instantaneous delivery of the high-pressure pump, it has been proposed instead to insert an adjustment device including a continuously varying hydraulic resistor, upstream of the pumping chamber, which hydraulic resistor is controlled according to the required pressure in the common-rail.

Both the above-described solutions for varying the instantaneous delivery of the high-pressure pump are mechanically complex and do not allow to adjust the instantaneous delivery of the high-pressure pump with high accuracy required in principle. Furthermore, in the delivery adjustment device, the varying section hydraulic resistor includes a relatively small introduction section in case of low deliveries such as to determine a local pressure drop (local load drop) which may compromise the correct operation of an intake valve which adjusts the fuel inlet into a pumping chamber of the high-pressure pump.

For this reason, it has been proposed, e.g., which is incorporated by reference, in EP-A-1612402, a solution which includes the use of a high-pressure pump including a number of pumping elements actuated in a reciprocating motion by means of corresponding intake and delivery strokes, and in which each pumping element is provided with a relative intake valve in communication with an intake pipe fed by the low pressure pump. On the intake pipe a shut-off valve is arranged for adjusting the instantaneous delivery of fuel fed to the high-pressure pump; in other words, the shut-off valve is a known valve of the open/closed (ON/OFF) type which is driven by modifying the ratio between the duration of the opening time and the duration of the closing time so as to vary the instantaneous delivery of fuel fed to the high-pressure pump. By operating in this manner, a shut-off valve may be used in which the introduction section is sufficiently large to avoid an appreciable local pressure drop (local load drop).

When the shut-off valve of the open/closed (ON/OFF) type is closed, a hydraulic phenomenon known as "water hammer" occurs in the intake pipe. The "water hammer" occurs in the intake pipe when the fuel flow therein is either interrupted by closing the shut-off valve or, on the other hand, when the shut-off valve is closed and opened in an essentially short interval of time. The "water hammer" consists in an overpressure which originates in proximity of the shut-off valve due to the impact of the moving fuel against a shutter of the shut-off valve and propagates along the intake pipe, resulting in an increase of noise generated by the injection assembly. The generated overpressure, in addition to depending on the dimensions of the intake pipe, i.e., on the length and the diameter of the intake pipe, also depends on the speed and density of the fluid and, above all, depends on the closing and opening time of the shut-off valve of the open/closed (ON/OFF) type, which is essentially reduced, i.e., in the order of $0.5*10^{-3}$ sec.

SUMMARY

An embodiment of the present invention provides a direct injection assembly of the common-rail type provided with a shut-off valve for controlling the delivery of a high-pressure fuel pump, such an injection assembly being free from the above-described drawbacks and being easy and cost-effective to implement.

BRIEF DESCRIPTION OF THE DRAWINGS

One or more embodiments of the present invention will now be described with reference to the accompanying drawings, which disclose a non-limitative embodiment thereof, in which.

DETAILED DESCRIPTION

Figure 1:
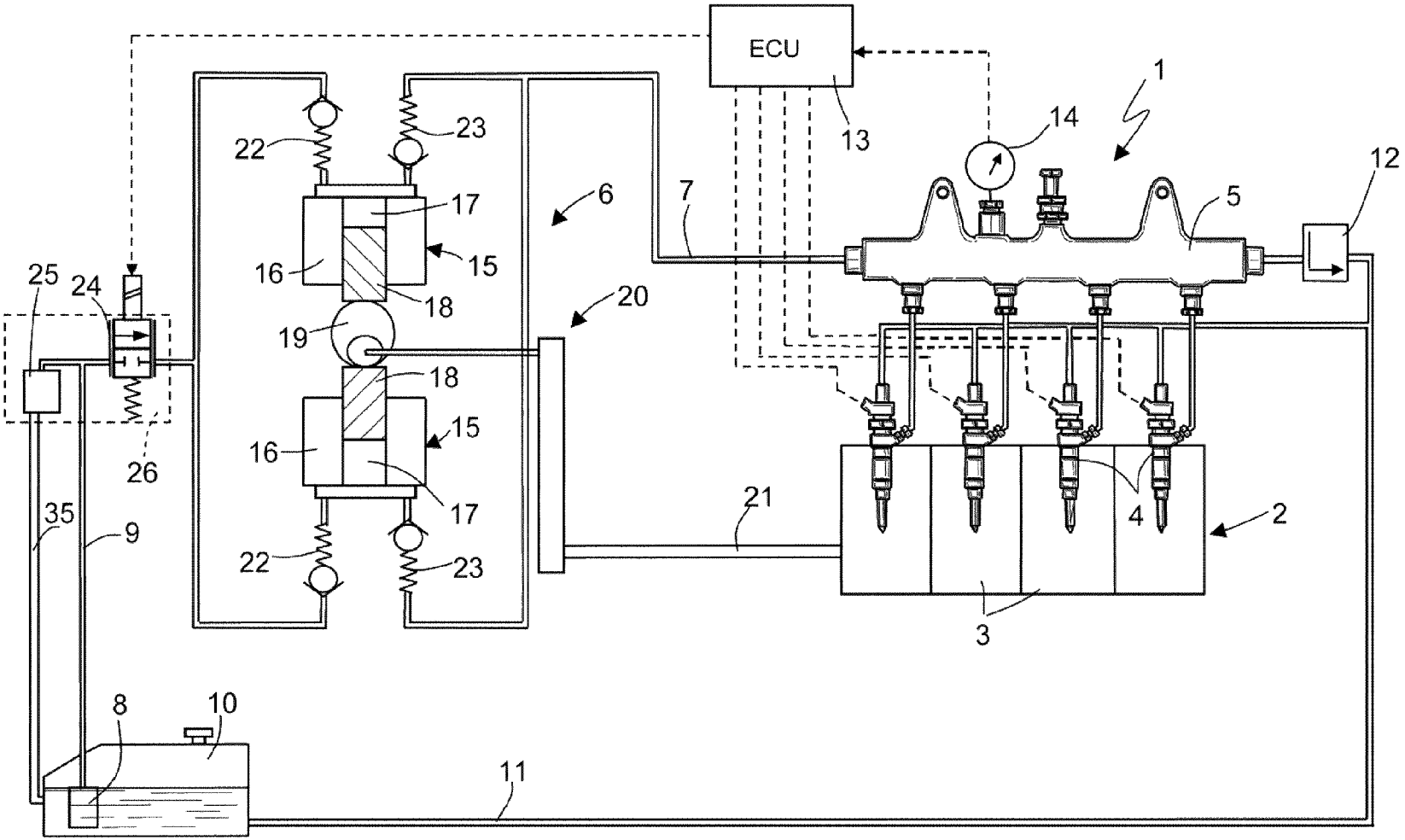
FIG. 1 diagrammatically illustrates, partially in blocks, an embodiment of the direct injection assembly of the present invention.

In FIG. 1, numeral 1 indicates as a whole an injection assembly of the common-rail type for the direct injection of fuel into an internal combustion engine 2 provided with four cylinders 3.

The injection assembly 1 includes four injectors 4, of known type, each of which is connected to a corresponding cylinder 3, includes a hydraulically actuated needle (not shown) and is adapted to inject the fuel directly into the corresponding cylinder 3 and to receive the pressurized fuel from a manifold 5 (named "common-rail").

Furthermore, the injection assembly 1 includes a high-pressure varying delivery pump 6, which is adapted to feed the fuel to the manifold 5 by means of a delivery pipe 7; and a low-pressure pump 8, which is arranged inside a fuel tank 10 and is adapted to feed the fuel to an intake pipe 9 of the high-pressure pump 6, which intake pipe is provided with a fuel filter (not shown).

Furthermore, the injection assembly 1 includes a return channel 11, which leads into the tank 10 and is adapted to receive the fuel in excess both from the injectors 4 and from a mechanical pressure-limiting valve 12, which is hydraulically connected to the manifold 5. The valve 12 is calibrated to open automatically when the pressure of the fuel inside the manifold 5 exceeds a safety value to ensure the tightness and the safety of the injection assembly 1.

Each injector 4 is adapted to inject a varying amount of fuel into the corresponding cylinder 3 under the control of an electronic control unit 13 constituting part of the injection assembly 1. As previously mentioned, each injector 4 is provided with a hydraulically actuated needle (not shown) and must receive, from the manifold 5*a*, a quantity of high-pressure fuel sufficient to actuate the corresponding needle (not shown) and to feed the corresponding cylinder 3 at a relatively high pressure. In order to do this, each injector 4 is fed with an amount of fuel in excess with respect to that actually injected and the excess is fed, by means of the return channel 11, to the tank 10 upstream of the low-pressure pump 8.

The electronic control unit 13 is connected to a sensor 14 for measuring the fuel pressure inside the manifold 5 and feedback controls the delivery of the high-pressure pump 6 so as to keep the pressure of the fuel inside the manifold 5 equal to a desired value which generally varies in time according to the driving point.

The high-pressure pump 6 includes a plurality of pumping elements, in this case a pair of pumping elements 15, each consisting of a cylinder 16 having a pumping chamber 17, in which a movable piston 18 slides in a reciprocating motion under the thrust of a eccentric 19 actuated by a mechanical transmission 20, which receives the motion from a drive shaft 21 of the internal combustion engine 2. Each compression chamber 17 is provided with a corresponding intake valve 22 in communication with the intake pipe 9, and with a corresponding delivery valve 23 in communication with the delivery pipe 7. The two pumping elements 15 are reciprocally actuated in phase opposition; consequently, the fuel sent to the high-pressure pump 6 through the intake pipe 9 is taken in by only one pumping element 15 at a time and, specifically, by the pumping element 15 which in that instant is performing the intake stroke (in the same instant, the intake valve 22 of the other pumping element 15 is obviously closed, the other pumping element 15 being at compression phase).

Along the intake pipe 9 a shut-off valve 24 is arranged, which displays an electromagnetic actuation, is controlled by the electronic control unit 13 and is of the open/closed (on/off) type; in other words, the shut-off valve 24 may only take either an entirely opening position or an entirely closing position. Specifically, the shut-off valve 24 displays a sufficiently wide introduction section to allow to feed each pumping element 15 without causing any substantial pressure drop.

The delivery of high-pressure pump 6 is controlled only by using the shut-off valve 24 which is feedback controlled by the electronic control unit 13 according to the fuel pressure in the manifold 5. Specifically, the electronic control unit 13 determines a desired fuel pressure value inside the manifold 5 instant-by-instant according to the driving point and adjusts the instantaneous delivery of fuel fed by the high-pressure pump 6 to the manifold 5 to follow the desired fuel pressure value inside the manifold 5 itself; in order to adjust the instantaneous delivery of fuel fed by the high-pressure pump 6 to the manifold 5, the electronic control unit 13 adjusts the instantaneous delivery of the fuel taken in by the high-pressure pump 6 through the shut-off valve 24 by varying the ratio between the duration of the opening time and the duration of the closing time of the shut-off valve 24 itself.

Figure 2:
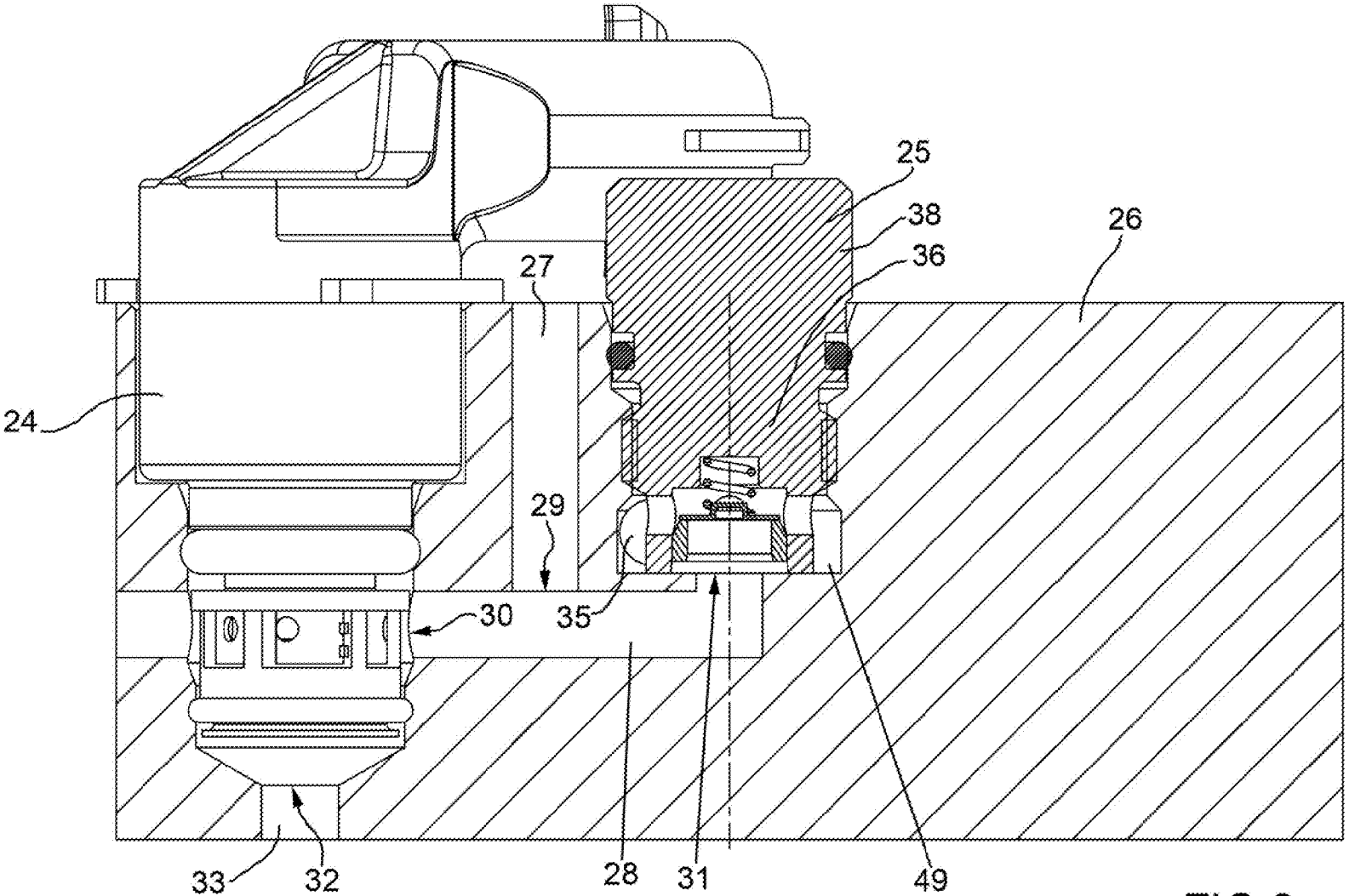
FIG. 2 shows a detail in FIG. 1 in section and on enlarged scale.

As shown in FIG. 2, the shut-off valve 24 is connected to a pressure regulator 25 and the two elements are accommodated next to each other in a supporting body 26. One segment 27 of the intake pipe 9 is also accommodated within the supporting body 26 and leads into a feeding channel 28 also obtained in the supporting body 26. The feeding channel 28 connects the shut-off valve 24 to the pressure regulator 25 and is provided with an intermediate opening 29 for connecting to the low-pressure pump 8 by means of a segment 27 of the intake pipe 9. The shut-off valve 24 and the pressure regulator 25 display two openings, indicated by numerals 30 and 31 respectively, for the introduction of fuel; the two openings 30 and 31, respectively, are arranged reciprocally perpendicular and are connected together by means of the feeding channel 28. Furthermore, the shut-off valve 24 displays a second fuel outlet opening 32, perpendicular to the opening 30, for connecting the shut-off valve 24 itself to the high-pressure pump 6 by means of a segment 33 of the intake pipe 9, also accommodated within the supporting body 26.

Figure 3:
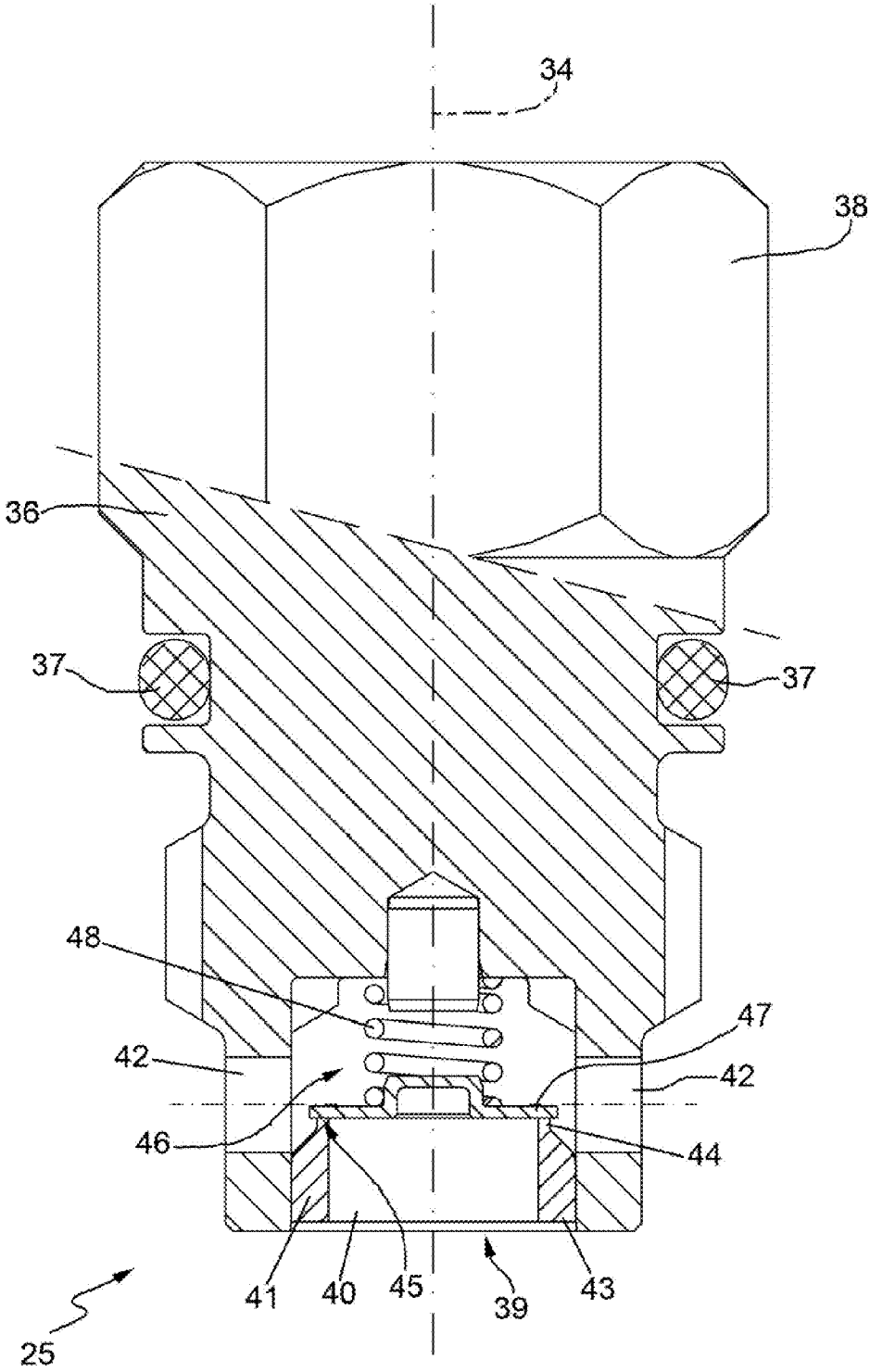
FIG. 3 shows a detail of FIG. 2 on an enlarged scale.

As shown in FIG. 3, the pressure regulator 25 displays a symmetry about a longitudinal axis 34 and axially receives the fuel conveyed into the intake channel 28, i.e., coaxially to the longitudinal axis 34. The fuel exiting from the pressure regulator 25 is instead fed radially, i.e., perpendicularly to the longitudinal axis 34, to an exhaust pipe 35, which is partially accommodated inside the supporting body 26, extends transversally to both the feeding channel 28 and to the longitudinal axis 34, and is adapted to convey the fuel to the fuel tank 10.

The pressure regulator 25 includes a central body 36 provided with an externally threaded portion to allow the coupling thereof with a nut screw embedded within the supporting body 26; on the external surface of the central body 36 a seat is obtained for accommodating a sealing ring 37 made of elastic material.

The top of the central body 36 is closed, has a varying section along the longitudinal axis 34 and protrudes beyond the supporting body 26 with an upper portion 38 thereof.

The central body 36 includes an axial inlet pipe 39, which is connected to the feeding channel 28 at the opening 31 and includes an inlet portion 40 accommodating a sleeve 41 and displays a plurality of radial outlet pipes 42 arranged immediately downstream of the inlet portion 40. The sleeve 41 includes a cylindrical inlet portion 43 accommodated inside the inlet portion 40 of the inlet pipe 39 and an outflow portion 44, which have an external truncated-cone shape and is arranged partially facing the radial outlet pipes 42. The outflow portion 44 displays an annular end defining a resting seat 45 of a shutter 46 including a small plate 47, axially movable against the bias of a calibrated spring 48, from a normal closing position, in contact with the resting seat 45, to an opening and communication position of the inlet pipe 39 with the radial outlet pipes 42.

The radial outlet pipes 42 put the inlet pipe 39 into communication with an annular chamber 49, which is obtained in the supporting body 26, communicates with the exhaust pipe 35 and is adapted to receive the fuel from the pressure regulator 25 and to direct it to the exhaust pipe 35 itself.

In use, when the shut-off valve 24 is closed in an essentially rapid manner, the fuel inside the feeding channel 28 impacts against a shutter of the shut-off valve 24 itself, thus generating an overpressure which propagates backwards along the feeding channel 28 to the pressure regulator 25. As a consequence of this pressure wave, the fuel penetrates through the opening 31 into the inlet pipe 39 and impacts against the small plate 47 of the shutter 46 arranged in the closing position in contact with the resting seat 45. If the pressure of the entering fuel is higher than the thrust of the spring 48, the small plate 47 is moved away from the resting seat 45 putting the inlet pipe 39 with the radial outlet pipes 42 and, thus, through the annular chamber 49 into communication with the exhaust pipe 35 and the tank 10. The calibration of the pressure regulator 25, during the step of assembling, occurs by adjusting the driving rate of the sleeve 41 within the central body 36.

The pressure regulator 25 includes four radial outlet pipes 42 (only two of which are shown in FIGS. 2 and 3) regularly distributed about the longitudinal axis 34. According to a variant (not shown), the pressure regulator 25 includes at least one radial outlet pipe 42 and the radial outlet pipes 42 may be regularly distributed about the longitudinal axis 34.

According to a variant (not shown), the supporting body 26 is directly integrated on the supporting body (not shown) of the high-pressure pump 6.

According to a further variant (not shown), the exhaust pipe 35 is adapted to convey the fuel to the return channel 11 which leads into the tank 10.

To ensure the correct operation of the system consisting of the pressure regulator 25 and the shut-off valve 24, the two components have similar reaction times so as to be able to fully dispose of the overpressure which is generated in the feeding channel 28 when the shut-off valve 24 is closed. For this purpose, the small plate 47 is made so as to display a relatively low inertia and the calibrated spring 48 is made with a relatively low number of turns so as to reduce the resistive force exerted by the shutter 46. Similarly, the profile of the outflow portion 44 of the sleeve 41 allows the fuel to fully exploit the port of the radial outlet pipes 42.

The overpressure which is generated in the feeding channel 28 when the shut-off valve 24 is closed further depends on the dimensions, i.e., on the length and the diameter, of the connection channels in which the fuel is conveyed. The load loss of the fuel which flows through the channels of the supporting body 26 is reduced to a minimum by arranging the shut-off valve 24 and the pressure regulator 25 side-by-side inside the supporting body 26.

The above-described injection assembly 1 displays several advantages because, by optimizing the weight of the shutter 46 and the layout of the connection channels in which the fuel flows, the reaction speed of the pressure regulator 25 is equivalent to that of the shut-off valve 24, i.e., of the order of $0.5*10^{-3}$ sec, and the injection assembly is able to fully dispose of the overpressure generated inside the feeding channel 28 by closing the shut-off valve 24 of the intake pipe.

The injection assembly 1 may be part of an engine assembly that may be part of a vehicle such as an automobile.

Naturally, in order to satisfy local and specific requirements, a person skilled in the art may apply to the solution described above many modifications and alterations. Particularly, although the present invention has been described with a certain degree of particularity with reference to described embodiment(s) thereof, it should be understood that various omissions, substitutions and changes in the form and details as well as other embodiments are possible. Moreover, it is expressly intended that specific elements and/or method steps described in connection with any disclosed embodiment of the invention may be incorporated in any other embodiment as a general matter of design choice.

What is claimed is:

1. A direct injection assembly of the common-rail type including:

a fuel tank;

a manifold;

a high-pressure pump for feeding the fuel to the manifold, the high-pressure pump presenting an intake pipe;

a low-pressure pump connected to the high-pressure pump by means of the intake pipe to feed the fuel taken from the tank to the high-pressure pump;

a shut-off valve of the ON/OFF type arranged along the intake pipe to adjust the delivery of the fuel fed to the high-pressure pump; and a pressure regulator which is arranged along the intake pipe immediately upstream of the shut-off valve to keep the pressure of the fuel inside the intake pipe under a predetermined value; and wherein the shut-off valve and the pressure regulator are arranged reciprocally side-by-side.

2. An injection assembly according to claim 1, and comprising a feeding channel connecting the shut-off valve and the pressure regulator to each other and presenting an intermediate inlet opening connected to the low-pressure pump by means of the intake pipe.

3. An injection assembly according to claim 2, wherein the shut-off valve and the pressure regulator present corresponding inlet openings reciprocally connected by the feeding channel.

4. An injection assembly according to claim 3, wherein the inlet openings lay on corresponding planes perpendicular to each other.

5. An injection assembly according to claim 1, and comprising a supporting body which at least partially accommodates the shut-off valve and the pressure regulator.

6. An injection assembly according to claim 5, wherein the feeding channel is obtained within the supporting body.

7. An injection assembly according to claim 1, wherein the pressure regulator comprises:

a central body displaying an axial inlet pipe including an inlet portion and at least one radial outlet pipe;

a shutter movable between an opening position of the communication between the inlet portion and the radial outlet portion and a closing position of the communication; the shutter including a small plate and a calibrated spring to normally keep the small plate in the closing position;

a sleeve arranged along the inlet portion and adapted to tightly cooperate with the shutter in the closing position.

8. An injection assembly according to claim 7, wherein the sleeve includes a first inlet portion tightly accommodated along the inlet portion and a second outflow portion cooperating with the small plate in the closing position.

9. An injection assembly according to claim 8, wherein, during the step of assembling, the sleeve is arranged at different heights of the inlet portion to adjust the dynamic response of the pressure regulator.

10. An injection assembly according to claim 9, wherein the second outflow portion is at least partially arranged facing the radial outlet pipe.

11. An injection assembly according to claim 8, wherein the first inlet portion has a cylindrical tubular shape.

12. An injection assembly according to claim 8, wherein the second outflow portion has an external truncated-cone shape which is tapered towards the small plate.

13. An injection assembly according to claim 7, and comprising a plurality of outlet pipes radially obtained through the tubular body.

14. An injection assembly according to claim 13, wherein the outlet pipes are regularly distributed about an axis of the central body.

15. An injection assembly according to claim 14, wherein there are four outlet pipes.

16. An injection assembly according to claim 7, wherein the small plate is made so as to display a relatively low inertia and the calibrated spring is made with a relatively low number of turns so as to reduce the resistive force exerted by the shutter during the passage from the opening position of the communication between the inlet portion and the radial outlet pipe and a closing position of the communication.

17. An injection assembly according to claim 7, and comprising an annular chamber coaxial to the axis for collecting the fuel exiting from the outlet pipes.

18. An injection assembly according to claim 17, wherein the annular chamber is obtained in the supporting body.

19. An injection assembly according to claim 18, and comprising an exhaust pipe connected to the annular chamber to intercept the fuel exiting from said annular chamber and convey it to the fuel tank.

20. An injection assembly according to claim 19, wherein the exhaust pipe is transversal to the feeding channel and to said axis.

21. An injection assembly according to claim 19, wherein the exhaust channel is at least partially obtained in the supporting body.

22. An injection assembly according to claim 7, and including a sealing ring made of elastic material and arranged in a seat obtained on the external surface of the central body.

23. A direct injection assembly of the common-rail type including:

a fuel tank;

a manifold;

a high-pressure pump for feeding the fuel to the manifold, the high-pressure pump presenting an intake pipe;

a low-pressure pump connected to the high-pressure pump by means of the intake pipe to feed the fuel taken from the tank to the high-pressure pump;

a shut-off valve of the ON/OFF type arranged along the intake pipe to adjust the delivery of the fuel fed to the high-pressure pump;

a pressure regulator which is arranged along the intake pipe immediately upstream of the shut-off valve to keep the pressure of the fuel inside the intake pipe under a predetermined value;

wherein the pressure regulator comprises a central body displaying an axial inlet pipe including an inlet portion and at least one radial outlet pipe; a shutter movable between an opening position of the communication between the inlet portion and the radial outlet portion and a closing position of the communication; the shutter including a small plate and a calibrated spring to normally keep the small plate in the closing position; a sleeve arranged along the inlet portion and adapted to tightly cooperate with the shutter in the closing position.

24. An injection assembly according to claim 23, wherein the sleeve includes a first inlet portion tightly accommodated along the inlet portion and a second outflow portion cooperating with the small plate in the closing position.

25. An injection assembly according to claim 24, wherein, during the step of assembling, the sleeve is arranged at different heights of the inlet portion to adjust the dynamic response of the pressure regulator.

26. An injection assembly according to claim 25, wherein the second outflow portion is at least partially arranged facing the radial outlet pipe.

27. An injection assembly according to claim 24, wherein the first inlet portion has a cylindrical tubular shape.

28. An injection assembly according to claim 24, wherein the second outflow portion has an external truncated-cone shape which is tapered towards the small plate.

29. An injection assembly according to claim 23, and comprising a plurality of outlet pipes radially obtained through the tubular body.

30. An injection assembly according to claim 29, wherein the outlet pipes are regularly distributed about an axis of the central body.

31. An injection assembly according to claim 30, wherein there are four outlet pipes.

32. An injection assembly according to claim 23, wherein the small plate is made so as to display a relatively low inertia and the calibrated spring is made with a relatively low number of turns so as to reduce the resistive force exerted by the shutter during the passage from the opening position of the communication between the inlet portion and the radial outlet pipe and a closing position of the communication.

33. An injection assembly according to claim 23, and comprising an annular chamber coaxial to the axis for collecting the fuel exiting from the outlet pipes.

34. An injection assembly according to claim 33, wherein the annular chamber is obtained in the supporting body.

35. An injection assembly according to claim 34, and comprising an exhaust pipe connected to the annular chamber to intercept the fuel exiting from said annular chamber and convey it to the fuel tank.

36. An injection assembly according to claim 35, wherein the exhaust pipe is transversal to the feeding channel and to said axis.

37. An injection assembly according to claim 35, wherein the exhaust pipe is at least partially obtained in the supporting body.

38. An injection assembly according to claim 23, and including a sealing ring made of elastic material and arranged in a seat obtained on the external surface of the central body.

* * * * *